US010001731B2

(12) United States Patent
Matsushita et al.

(10) Patent No.: US 10,001,731 B2
(45) Date of Patent: Jun. 19, 2018

(54) COMPOSITION FOR SEAMLESS BELT, AND IMAGE FORMING APPARATUS USING THE BELT

(71) Applicants: Makoto Matsushita, Tokyo (JP); Akira Izutani, Osaka (JP); Hideaki Yasunaga, Tokyo (JP); Keiichiro Juri, Kanagawa (JP); Ayano Momose, Tokyo (JP); Yuri Haga, Kanagawa (JP); Hiroaki Takahashi, Kanagawa (JP)

(72) Inventors: Makoto Matsushita, Tokyo (JP); Akira Izutani, Osaka (JP); Hideaki Yasunaga, Tokyo (JP); Keiichiro Juri, Kanagawa (JP); Ayano Momose, Tokyo (JP); Yuri Haga, Kanagawa (JP); Hiroaki Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 79 days.

(21) Appl. No.: 14/959,119

(22) Filed: Dec. 4, 2015

(65) Prior Publication Data

US 2016/0187816 A1 Jun. 30, 2016

(30) Foreign Application Priority Data

Dec. 26, 2014 (JP) ..... 2014-265726

(51) Int. Cl.

| | |
|---|---|
| ***H01B 1/12*** | (2006.01) |
| ***G03G 15/01*** | (2006.01) |
| ***G03G 15/16*** | (2006.01) |
| ***H01B 1/20*** | (2006.01) |
| ***G03G 5/10*** | (2006.01) |
| ***G03G 7/00*** | (2006.01) |

(52) U.S. Cl.

CPC ..... *G03G 15/162* (2013.01); *G03G 5/104* (2013.01); *G03G 5/105* (2013.01); *G03G 7/004* (2013.01); *G03G 7/0046* (2013.01); *H01B 1/12* (2013.01); *H01B 1/20* (2013.01)

(58) Field of Classification Search

None

See application file for complete search history.

(56) References Cited

U.S. PATENT DOCUMENTS

| | | | | |
|---|---|---|---|---|
| 5,258,154 | A * | 11/1993 | Okuyama | G03G 7/0066 264/105 |
| 6,610,766 | B1 * | 8/2003 | Kitamura | C03C 17/32 428/364 |
| 2007/0178254 | A1 * | 8/2007 | Shimomura | G03G 15/0131 428/32.51 |
| 2009/0041514 | A1 | 2/2009 | Maehara | |
| 2009/0142107 | A1 | 6/2009 | Izutani et al. | |
| 2009/0279909 | A1 | 11/2009 | Matsushita et al. | |
| 2009/0324270 | A1 | 12/2009 | Yamashita et al. | |
| 2011/0008069 | A1 | 1/2011 | Matsushita et al. | |
| 2011/0217653 | A1 | 9/2011 | Izutani et al. | |
| 2011/0236080 | A1 | 9/2011 | Kouno | |
| 2011/0243616 | A1 | 10/2011 | Nakagawa et al. | |
| 2011/0249994 | A1 | 10/2011 | Matsushita et al. | |
| 2012/0237270 | A1 | 9/2012 | Juri et al. | |
| 2012/0243916 | A1 | 9/2012 | Oomori et al. | |
| 2012/0294657 | A1 | 11/2012 | Matsushita et al. | |
| 2012/0315067 | A1 | 12/2012 | Takahashi | |
| 2013/0058685 | A1 | 3/2013 | Juri et al. | |
| 2014/0212184 | A1 | 7/2014 | Juri et al. | |
| 2014/0243465 | A1 | 8/2014 | Matsushita et al. | |
| 2014/0321888 | A1 | 10/2014 | Yasunaga et al. | |
| 2015/0014602 | A1 | 1/2015 | Matsushita et al. | |
| 2015/0078777 | A1 | 3/2015 | Juri et al. | |
| 2015/0078790 | A1 | 3/2015 | Ishikawa et al. | |
| 2015/0078791 | A1 | 3/2015 | Momose et al. | |

FOREIGN PATENT DOCUMENTS

| | | |
|---|---|---|
| EP | 1947526 A1 | 7/2008 |
| JP | 2002-328543 | 11/2002 |
| JP | 2003-177612 | 6/2003 |
| JP | 2012-78514 | 4/2012 |
| JP | 2014-002410 | 1/2014 |

OTHER PUBLICATIONS

Apr. 28, 2016 European Search Report in corresponding European Patent Application No. EP 15202730.6.
U.S. Appl. No. 14/731,556, filed Jun. 5, 2015.

* cited by examiner

*Primary Examiner* — Katie L Hammer
(74) *Attorney, Agent, or Firm* — Cooper & Dunham LLP

(57) ABSTRACT

A composition for seamless belt includes a thermoplastic resin; and a conductive agent. A liquid extracted from the composition with methanol has an intensity not greater than $7\times10^8$ in a total ion chromatogram.

6 Claims, 3 Drawing Sheets

COMPOSITION FOR SEAMLESS BELT, AND IMAGE FORMING APPARATUS USING THE BELT

CROSS-REFERENCE TO RELATED APPLICATIONS

This patent application is based on and claims priority pursuant to 35 U.S.C. § 119 to Japanese Patent Application No. 2014-265726, filed on Dec. 26, 2014, in the Japan Patent Office, the entire disclosure of which is hereby incorporated by reference herein.

BACKGROUND

Technical Field

The present invention relates to a composition for seamless belt, a seamless belt and an image forming apparatus.

Description of the Related Art

A composition for seamless belt including a thermoplastic resin and a conductive agent as a material for seamless belt in an electrophotographic image forming apparatus is known.

However, in preparation of a composition for seamless belt, when a conductive agent is dispersed in a thermoplastic resin by melting and kneading, the thermoplastic resin is resolved and a low-molecular-weight component bleeds from the seamless belt, resulting in occurrence of an image void in an environment of high-temperature and high-humidity.

In addition, a semi-conductive endless belt formed of a thermoplastic resin which is a fluorine-based resin having a melting point not higher than 190° C., an ion conductive material and a porous silica having an oil absorption of form 50 to 350 ml/100 g when measured according to JIS K5101-13 is disclosed. However, the semi-conductive endless belt has a problem of poor cleaning performance.

SUMMARY

A composition for seamless belt, including a thermoplastic resin; and a conductive agent, wherein a liquid extracted from the composition with methanol has an intensity not greater than $7\times10^8$ in a total ion chromatogram.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
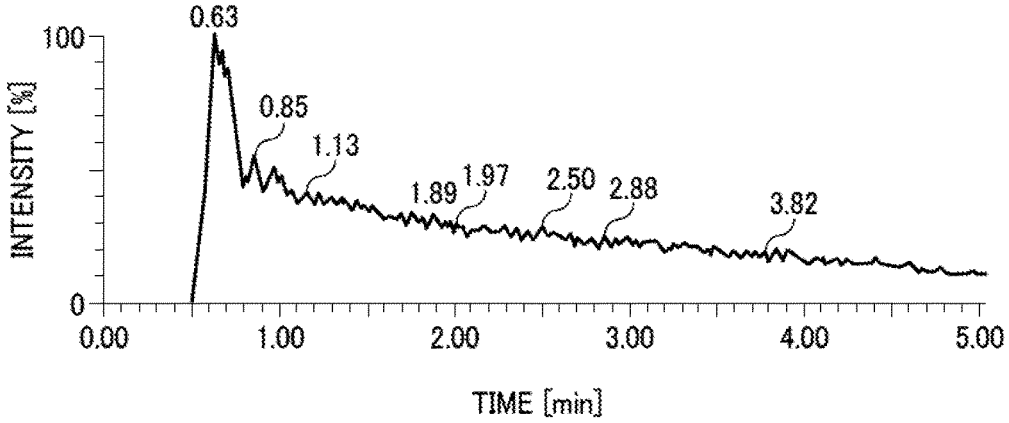
FIG. 1 is an example of total ion chromatogram of a liquid extracted from a composition for seamless belt with methanol.

Accordingly, one object of the present invention is to provide a composition for seamless belt used in an image forming apparatus, capable of preventing an image void in an environment of high-temperature and high-humidity and defective cleaning.

Another object of the present invention is to provide a seamless belt using the composition.

A further object of the present invention is to provide an image forming apparatus using the seamless belt.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The composition for seamless belt includes a thermoplastic resin and a conductive agent, and a liquid extracted therefrom with methanol has an intensity not greater than $7\times10^8$ in a total ion chromatogram (TIC). When the intensity is higher than $7\times10^8$, a low-molecular-weight component bleeds from the seamless belt and adheres to a photoconductor, resulting in occurrence of an image void. In addition, the low-molecular-weight component enters an edge of a cleaning blade, resulting in defective cleaning.

The TIC can be measured by an electrospray ionization method (ESI) using a positive ion mode.

FIG. 1 is an example of TIC in which the intensity has a maximum value of $8.66\times10^8$. 100% means an intensity of $8.66\times10^8$.

Figure 2:
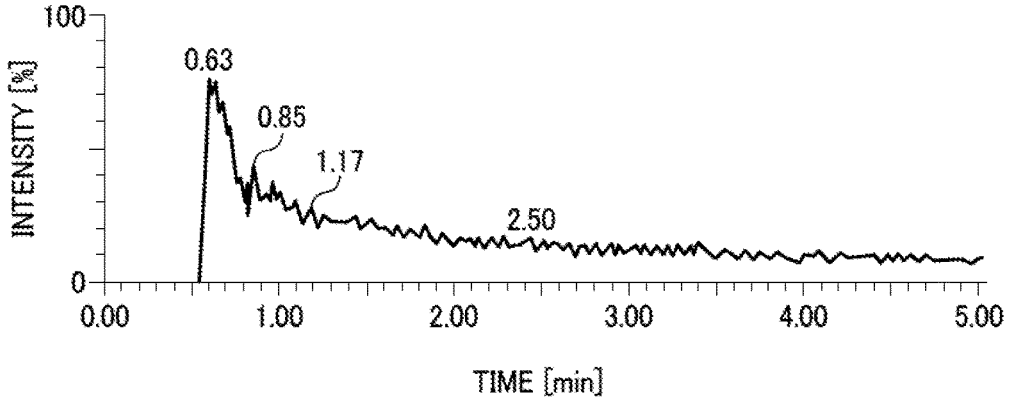
FIG. 2 is another example of total ion chromatogram of a liquid extracted from a composition for seamless belt with methanol.

FIG. 2 is an example of TIC in which the intensity has a maximum value of $6.56\times10^8$. 100% means an intensity of $8.66\times10^8$.

Figure 3:
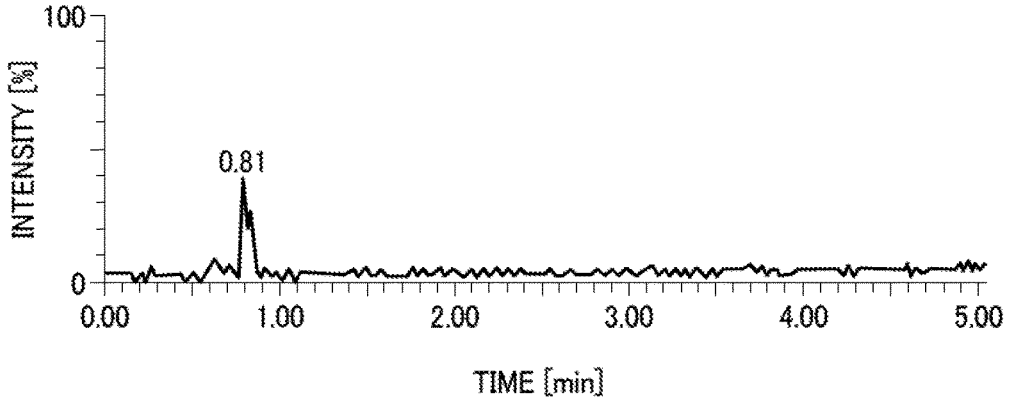
FIG. 3 is an example of total ion chromatogram of methanol.

FIG. 3 is a TIC of methanol as a blank TIC, in which the intensity has a maximum value of $7.95\times10^7$. 100% means an intensity of $8.66\times10^8$.

Specific examples of the thermoplastic resin include, but are not limited to, polyamide, polyethylene (PE), polypropylene (PP), polyvinyl chloride (PVC), polyvinylidene chloride, polystyrene(PS), polyvinyl acetate (PVAc), ABS resin (acrylonitrile-butadiene-styrene resin), AS resin, acrylic acid resin (PMMA), polyamide (PA), nylon, polyacetal (POM), polycarbonate (PC), modified polyphenylene ether (m-PPE, modified PPE and PPO), polybutylene terephthalate (PBT), polybutylene naphthalate (PBN), polyethylene terephthalate (PET), cyclic polyolefin (COP), polyphenylenesulfide (PPS), polytetrafluoroethylene (PTFE), polysulfone (PSF), polyethersulfone (PES), amorphous polyarylate (PAR), liquid crystal polymer (LCP), polyetheretherketone (PEEK), thermoplastic polyimide (PI) and may use two kinds or more together. Above all, at least one of polyvinylidene fluoride (PVDF-hexafluoropropylene copolymer and a vinylidene fluoride-hexafluoropropylene copolymer is preferably used because they are easy to push out, and they have less thermolysis when melted and kneaded and less resolution by shearing.

The composition for seamless belt typically includes a thermoplastic resin in an amount of from 50% to 97% by weight, and preferably from 80% to 90% by weight.

Specific examples of the conductive agent include, but are not limited to, carbon black, carbon nanotube, graphite, titanium oxide, tin oxide, antimony and a conductive polymer. These can be used alone or in combination. Above all, carbon black is preferably used because of easily being obtainable at low cost.

The composition for seamless belt typically includes a conductive agent in an amount of from 1% to 30% by weight, and preferably from 3% to 10% by weight.

The composition for seamless belt may further include an antistat. This decreases unevenness of the surface resistivity on the seamless belt.

The antistat includes alkyleneoxide.

Alkylene oxide includes, but is not limited to, ethylene oxide and propylene oxide. These can be used alone or in combination.

Marketed antistats include, but are not limited to, PELECTRON PVH from Sanyo Chemical Industries, Ltd. and Irgastat P18 from Ciba-Geigy.

The composition for seamless belt typically includes an antistat in an amount of from 0.1% to 20% by weight, and preferably from 0.5% to 10% by weight. When not less than 0.5% by weight, the unevenness of the surface resistivity on the seamless belt can further be decreased. When not greater than 10% by weight, a liquid extracted from the composition with methanol can have a TIC intensity not greater than $7\times10^8$.

The composition for seamless belt typically includes water in an amount of from 300 to 3,000 ppm, and preferably from 500 to 1,500 ppm. When not less than 500 ppm, the seamless belt has sufficient conductivity. When not greater than 1,500 ppm, defective cleaning can be further prevented.

The composition for seamless belt typically has a Martens hardness of from 50 to 500 N/mm$^2$, and preferably from 70 to 120 N/mm$^2$ When not less than 70 N/mm$^2$, defective cleaning can be further prevented. When not greater than 120 N/mm$^2$, the surface of the seamless belt is refreshed to keep glossiness.

The composition for seamless belt can be prepared by melting and kneading a composition including a thermoplastic resin and a conductive agent.

The composition for seamless belt has the shape of a pellet or a powder, but is not limited thereto.

The seamless belt can be prepared by extrusion-molding the composition for seamless belt with a metal mold.

A spiral die or a coat hanger die can be used as the metal mold.

A sizing die is preferably set inside the composition for seamless belt extruded from the metal mold. This stabilizes circularity and thickness of the seamless belt in a circumferential direction thereof.

The image forming apparatus includes a photoconductor, a charger charging the photoconductor, an irradiator irradiating the photoconductor to form an electrostatic latent image thereon, an image developer developing the electrostatic latent image formed on the photoconductor with a toner to form a toner image, a first transferer transferring the toner image formed on the photoconductor onto the seamless belt, a second transferer transferring the toner image transferred on the seamless belt onto a recording medium, and a cleaning blade cleaning the seamless belt the toner image has been transferred from.

The cleaning blade preferably has a Martens hardness of from 7 to 15 N/mm$^2$. When not less than 7 N/mm$^2$, the cleaning blade improves in cleanability. When not greater than 15 N/mm$^2$, the cleaning blade has a long life.

The cleaning blade can be prepared by known methods such as a method disclosed in Japanese published unexamined application No. JP-2011-141449-A.

The toner typically has a glass transition temperature of from 60° C. to 80° C.

The toner preferably includes polyester.

Methods of preparing the toner include, but are not particularly limited to, kneading pulverization methods, polymerization methods, dissolution suspension methods, and spray granulation methods. Among these, the polymerization methods such as suspension polymerization methods, emulsion polymerization methods and dispersion polymerization methods are preferably used to improve image quality.

The kneading pulverization methods include melting and kneading toner materials including a binder resin and a colorant, pulverizing the kneaded mixture, and classifying the pulverized mixture to prepare a mother particle. A mixture including the toner materials is melted and kneaded in a melt-kneader.

The melt-kneaders are not particularly limited, and include monoaxial or biaxial continuous kneaders and batch kneaders such as roll mills.

Specific examples of the melt-kneaders include KTK double-axis extruders manufactured by Kobe Steel, Ltd., TEM extruders manufactured by Toshiba Machine Co., Ltd., double-axis extruders manufactured by KCK Co., Ltd., PCM double-axis extruders manufactured by Ikegai Corp., and KO-KNEADER manufactured by Buss AG.

The kneaded mixture is preferably pulverized after crushed.

Methods of pulverizing the kneaded mixture are not particularly limited, and include a method in which the particles collide with a collision board in a jet stream; a method in which the particles collide with each other in a jet stream; and a method in which the particles are pulverized in a narrow gap formed between a mechanically rotating rotor and a stator.

The pulverized mixture particles are classified by removing microscopic particles with a cyclone, a decanter, a centrifugal separator, etc.

After the pulverized mixture is classified, it may be further classified by centrifugal force in an air stream.

The toner is prepared by adding an external additive such as silica particles to the mother particle. Then, the mother particle and the external additive are mixed and stirred by a mixer to make the external additive adhere to the surface of the mother particle while crushed.

The polymerization method includes dissolving or dispersing a polyester prepolymer having a group capable of forming a urea bond or a urethane bond and toner materials including a colorant in an organic solvent to prepare a first liquid, and dispersing the first liquid in an aqueous medium and subjecting the liquid to a polyaddition reaction to prepare a second liquid, and removing the organic solvent the second liquid to prepare a mother particle.

Specific examples of the group capable of forming a urea bond or a urethane bond include, but are not limited to, isocyanate groups.

The polyester prepolymer having an isocyanate group is reacted with amines and a molar chain of the polyester prepolymer is crosslinked and/or elongated to obtain a urea-modified polyester, which improves hot offset resistance while maintain low-temperature fixability of the resultant toner.

The polyester prepolymer having an isocyanate group is obtained by reacting polyester having a hydroxyl group with polyisocyanate.

Specific examples of the polyisocyanates include, but are not limited to, aliphatic polyisocyanates (e.g., tetramethylene diisocyanate, hexamethylene diisocyanate and 2,6-diisocyanate methyl caproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic aliphatic diisocyanates (e.g., α,α,α',α'-tetramethyl xylylene diisocyanate) and isocyanurates. These compounds can be used alone or in combination.

A molar ratio of the isocyanate group relative to the hydroxyl group when the polyester having a hydroxyl group is reacted with the polyisocyanate is typically from 1 to 5, preferably from 1.2 to 4, and more preferably from 1.5 to 2.5

The number of the isocyanate groups of the polyester prepolymer having an isocyanate group is typically not less than 1, preferably from 1.5 to 3, and more preferably from 1.8 to 2.5 per molecule.

Specific examples of the amines include, but are not limited to, diamines, polyamines having three or more amino groups, amino alcohols, amino mercaptans and amino acids.

Specific examples of the diamines include aromatic diamines such as phenylene diamine, diethyltoluene diamine and 4,4-diaminodiphenyl methane; alicyclic diamines such as 4,4-diamino-3,3-dimethyldicyclohexyl methane, diaminocyclohexane and isophoronediamine; aliphatic diamines such as ethylene diamine, tetramethylene diamine and hexamethylene diamine, etc.

Specific examples of the polyamines having three or more amino groups include diethylene triamine, triethylene tetramine, etc.

Specific examples of the amino alcohols include ethanol amine, hydroxyethyl aniline, etc.

Specific examples of the amino mercaptan include aminoethyl mercaptan, aminopropyl mercaptan, etc.

Specific examples of the amino acids include amino propionic acids, amino caproic acids, etc.

Among these amines, the diamines and mixtures in which the diamine is mixed with a small amount of the polyamine are preferably used.

Further, the amines may be ketimine or oxazoline in which the amino groups are blocked with ketone such as acetone, methyl ethyl ketone and methyl isobutyl ketone.

A molar ratio of the isocyanate group relative to the amino group when the polyester prepolymer having an isocyanate group is reacted with the amines is typically from 0.5 to 2, preferably from 2/3 to 1.5, and more preferably from 5/6 to 1.2.

Dispersers used for dispersing the first liquid in the aqueous medium includes, but are not limited to, low-speed shearing dispersers, high-speed shearing dispersers, friction dispersers, high-pressure dispersers and ultrasonic dispersers. The high-speed shearing dispersers are preferably used because of forming dispersed materials having a particle diameter of from 2 to 20 μm.

The high-speed shearing dispersers typically has the number of rotations of from 1,000 to 30,000 rpm, and preferably from 5,000 to 20,000 rpm.

The dispersion time of the high-speed shearing dispersers in batch methods is typically from 0.1 to 5 min.

The dispersion temperature of the high-speed shearing dispersers is typically from 0° C. to 150° C., and preferably from 40° C. to 98° C. under pressure.

A weight ratio of the aqueous medium to the toner materials is typically from 0.5 to 20, and preferably from 1 to 10.

Specific examples of methods of removing the organic solvent from the second liquid include, but are not limited to, a method of gradually heating the whole reaction system to evaporate the organic solvent in the dispersion, and a method of spraying the second liquid in a dried atmosphere to remove the organic solvent in the dispersion.

The mother particle can be washed, dried, and classified. Then, the mother particle may be classified by removing microscopic particles from the mother particle with a cyclone, a decanter, a centrifugal separator, etc. before or after the mother particle is dried.

The toner is prepared by mixing the mother particle with particles such as the external additive and an optional charge controlling agent. Then, a mechanical impact is applied to prevent the particles such as the external additive from leaving from the surface of the mother particle.

Specific examples of methods of applying a mechanical impact include, but are not limited to, a method of applying an impact to the particles with a blade rotating at high speed, and a method of placing the particles in a high-speed airstream and accelerating them to collide with each other or an impact plate.

Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), and automatic mortars.

The toner typically has an average circularity not less than 0.97, and more preferably from 0.97 to 0.98.

The average circularity of the toner is measured with a flow-type particle image analyzer FPIA-1000 from Sysmex Corp.

The toner typically has a volume-average particle diameter not greater than 5.5 μm.

A ratio of the volume-average particle diameter to a number-average particle diameter of the toner is typically from 1.00 to 1.40.

The volume-average particle diameter and the number-average diameter are measured Coulter Counter TA-II or Coulter Multisizer II from Coulter Electronics, Inc.

The toner may be mixed with a carrier to be used as a two-component developer.

A weight ratio of the toner to the carrier is typically from 0.01 to 0.10.

Specific examples of materials forming the carrier include, but are not limited to, iron, ferrite and magnetite.

The carrier typically has a particle diameter of from 20 to 200 μm approximately.

The carrier may be coated with a resin.

Specific examples of the resin include, but are not limited to, halogenated olefin resins such as urea-formaldehyde resins, melamine resins, benzoguanamine resins, urea resins, and polyamide resins, and epoxy resins, vinyl resins, vinylidene resins, acrylic resins, polymethylmethacrylate resins, polyacrylonitirile resins, polyvinyl acetate resins, polyvinyl alcohol resins, polyvinyl butyral resins, polystyrene resins, styrene-acrylic copolymer resins and polyvinyl chloride resins; polyester resins such as polyethyleneterephthalate resins and polybutyleneterephthalate resins; polycarbonate resins; polyethylene resins; polyvinyl fluoride resins; polyvinylidene fluoride resins; polytrifluoroethylene resins; polyhexafluoropropylene resins; vinylidenefluoride-acrylate copolymers; vinylidenefluoride-vinylfluoride copolymers; fluoroterpolymers of tetrafluoroethylene, vinylidenefluoride and other monomers including no fluorine atom; and silicone resins.

The resin may include an electroconductive powder.

Specific examples of the electroconductive powder include, but are not limited to, metal powders, carbon blacks, a titanium oxide powder, a tin oxide powder, and a zinc oxide powder.

The electroconductive powder typically has an average particle diameter not greater than 1 μm.

The toner can also be used as a one-component magnetic developer or a one-component non-magnetic developer without being mixed with the carrier.

Figure 4:
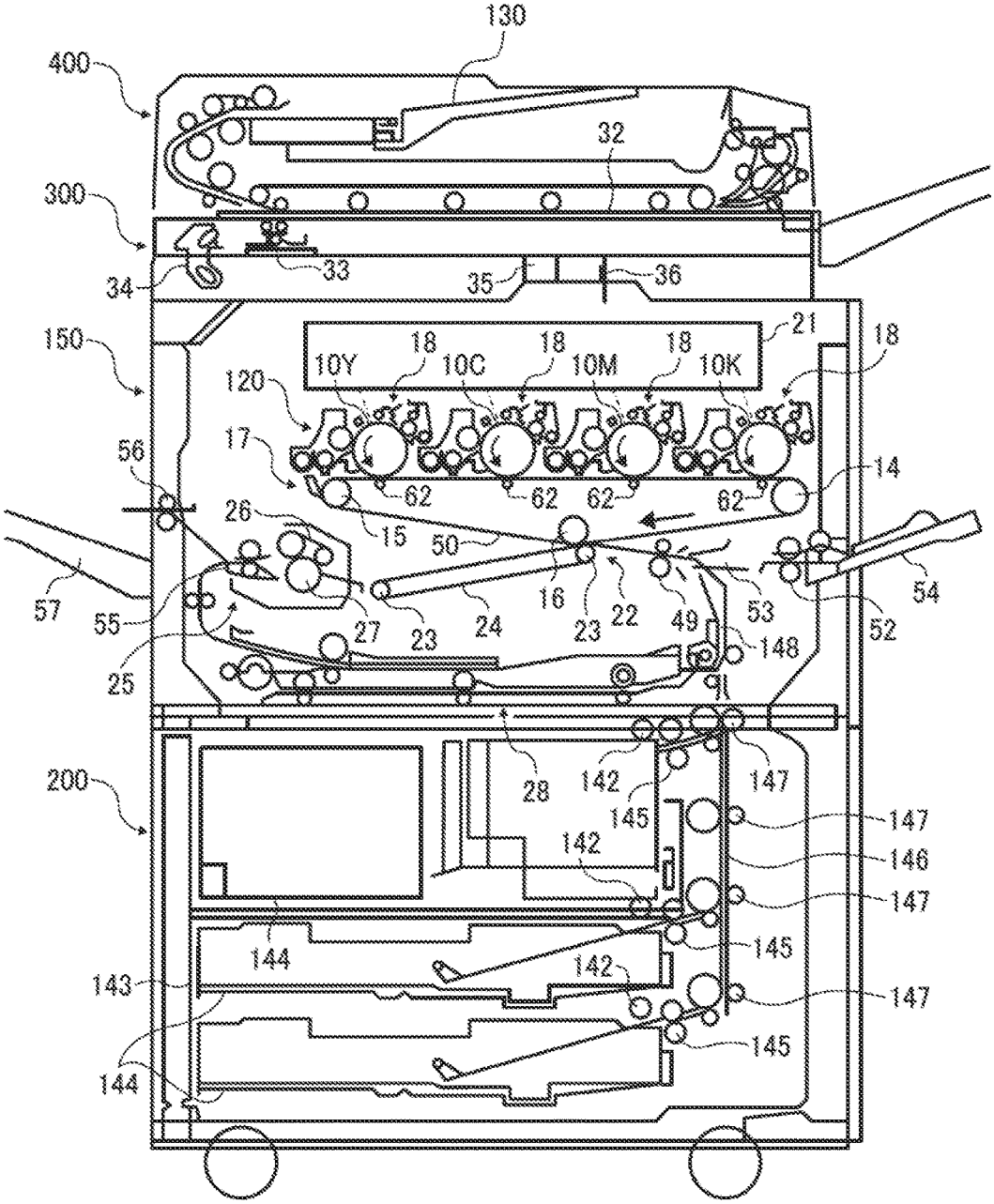
FIG. 4 is a schematic view illustrating an embodiment of the image forming apparatus of the present invention.
Figure 5:
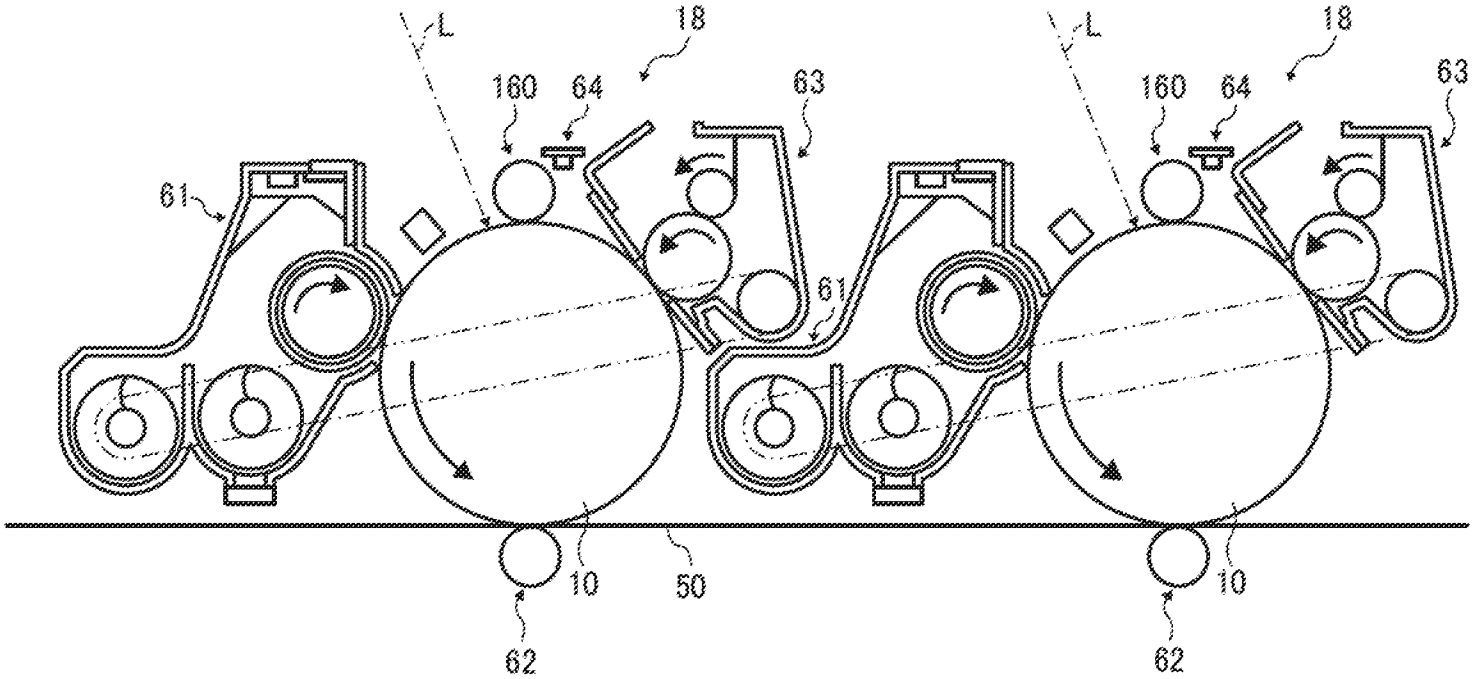
FIG. 5 is a schematic view illustrating another embodiment of the image forming apparatus of the present invention.

An embodiment of the image forming apparatus of the present invention is explained, referring to FIGS. 4 and 5.

An image forming apparatus in FIG. 4 includes a main body 150, a paper feed table 200, a scanner 300, and an automatic document feeder (ADF) 400.

A seamless-belt shaped intermediate transferer 50 is disposed at the center of the main body 150. The intermediate transferer 50 is stretched taut with support rollers 14, 15, and 16 and is rotatable clockwise in FIG. 4. A cleaner 17 is disposed adjacent to the support roller 15 to remove residual toner particles remaining on the intermediate transferer 50. Four image forming units 18 adapted to form respective toner images of yellow, cyan, magenta, and cyan are disposed in tandem facing a surface of the intermediate transferer 50 stretched between the support rollers 14 and 15. The image forming units 18 forms a tandem image developer 120.

An irradiator 21 is disposed adjacent to the tandem image developer 120. A second transferer 22 is disposed on the opposite side of the tandem developing device 120 with respect to the intermediate transferer 50. The second transferer 22 includes a seamless secondary transfer belt 24 stretched taut with a pair of rollers 23. The second transferer 22 is configured such that the secondary transfer belt 24 conveys a recording medium while keeping the recording medium contacting the intermediate transferer 50. A fixer 25 is disposed adjacent to the second transferer 22. The fixer 25 includes a seamless fixing belt 26 and a pressing roller 27 pressed against the fixing belt 26.

A reverser 28 adapted to reverse recording medium in duplexing is disposed adjacent to the second transferer 22 and the fixing device 25.

Next, full-color image formation (color copy) using the tandem image developer 120 is explained. A document is set on a document table 130 of the automatic document feeder 400. Alternatively, a document is set on a contact glass 32 of the scanner 300 while lifting up the automatic document feeder 400, followed by holding down of the automatic document feeder 400.

Upon pressing of a switch, in a case in which a document is set on the contact glass 32, the scanner 300 immediately starts driving so that a first runner 33 and a second runner 34 start moving. In a case in which a document is set on the automatic document feeder 400, the scanner 300 starts driving after the document is fed onto the contact glass 32. The first runner 33 directs light from a light source to the document, and reflects a light reflected from the document toward the second runner 34. A mirror in the second runner 34 reflects the light toward a reading sensor 36 through an imaging lens 35. The light is then received by a reading sensor 36. Thus, the document is read and image information of black, cyan, magenta, and yellow are obtained.

Then, each image information of black, yellow, magenta, and cyan is transmitted to corresponding image forming units 18 (black image forming unit, yellow image forming unit, magenta image forming unit, and cyan image forming unit) in the tandem type developing unit 120 to form each toner image of black, yellow, magenta, and cyan in each image forming unit.

Specifically, as illustrated in FIG. 5, each image forming unit 18 (black image forming unit, yellow image forming unit, magenta image forming unit, and cyan image forming unit) in the tandem type developing unit 120 has a latent electrostatic image bearing member 10 as a photoconductor (black latent electrostatic image bearing member 10K, yellow latent electrostatic image bearing member 10Y, magenta latent electrostatic image bearing member 10M, and cyan latent electrostatic image bearing member 10C, a charger 60 that uniformly charges the latent electrostatic bearing member 10, an irradiator that exposes the latent electrostatic image bearing member 10 with L illustrated in FIG. 5 according to the color image information to form a latent electrostatic image corresponding to each color image on the latent electrostatic image bearing member 10, a developing unit 61 that develops the latent electrostatic image by using each color toner (black toner, yellow toner, magenta toner, and cyan toner) to form a toner image of each color toner, a transfer charger 62 as a first transferer that transfers the toner image onto the intermediate transferer 50, a cleaning device 63, and a discharger 64, to form each single color image (black image, yellow image, magenta image, and cyan image) based on each color image formation.

The black image, yellow image, magenta image, and cyan image formed in this manner, that is, the black image formed on the black latent electrostatic image carrier 10K, yellow image formed the yellow latent electrostatic image carrier 10Y, magenta image formed on the magenta latent electrostatic image bearing member 10M, and cyan image formed on the cyan latent electrostatic image bearing member 10C are transferred (primary transfer) one by one to the intermediate transferer 50 which is rotationally transferred by the support rollers 14, 15, and 16. Then, the black image, yellow image, magenta image, and cyan image are superimposed sequentially on the intermediate transferer 50 to form a synthetic color image (color transfer image).

In the paper feeding table 200, one of the paper feed rollers 142 is selectively rotated to draw a recording medium from one of multistage paper feed cassettes 144 provided in a paper bank 143. A separating roller 145 separates the recording media one by one by to feed each paper to a paper feed path 146. The recording medium is conveyed by a conveyer roller 147, introduced into a paper feed path 148 in the main body 150, strikes a registration roller 49, and is held there. Alternatively, the recording medium on a manual tray 54 is fed one by one by a separating roller 52, introduced into a manual paper feed path 53, strikes a registration roller 49, and is held there. Although the registration roller 49 is usually used in a grounded condition, a bias can be applied thereto to remove paper dust of the recording medium.

Then, the registration roller 49 feeds the recording medium between the intermediate transferer 50 and the second transferer 22 by rotating in synchronization with the synthetic color image (color transfer image) synthesized on the intermediate transferer 50. The second transferer 22 secondly transfers the synthetic color image (color transfer image) to the recording medium to form the color image thereon. Residual toner left on the intermediate transferer 50 after the image transfer is removed by the intermediate transferer cleaner 17.

The recording medium onto which the color image is transferred is conveyed by the second transferer 22 and fed to a fixer 25 including a fixing belt 26 and pressure roller 27, where the synthetic color image (color transfer image) is fixed onto the recording medium by heat and pressure. Then, the recording medium is turned by a switching claw 55, discharged by a discharge roller 56, and stuck on a paper discharge tray 57. Alternatively, the recording medium is turned by the switching claw 55, inversed by the reverser 28, introduced again into the transfer position to record an image on the backside thereof, then, discharged by the discharge roller 56, and stuck on the discharge tray 57.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

The following materials were melted and kneaded in a biaxial extruder.

| | |
|---|---|
| Nylon 12, UBESTA 3030UFX1 from Ube Industries, Ltd. | 93 |
| Carbon Black, Denka Black from DENKA DENKI KAGAKU KOGYO KABUSHIKI KAISHA | 7 |

The kneaded mixture was pelletized with a pelletizer to obtain a pellet.

A liquid extracted from the pellet with methanol had a maximum intensity of $6.0\times10^8$ in a total ion chromatogram (TIC).

Example 2

The procedure for preparation of the pellet in Example 1 was repeated except for replacing 93 parts of Nylon 12, UBESTA 3030UFX1 from Ube Industries, Ltd. with 88 parts thereof and 5 parts of an antistat including ethylene oxide PELECTRON PVH from Sanyo Chemical Industries, Ltd. A liquid extracted from the pellet with methanol had a maximum intensity of $6.9\times10^8$ in a total ion chromatogram (TIC).

Example 3

The procedure for preparation of the pellet in Example 1 was repeated except for replacing 93 parts of Nylon 12, UBESTA 3030UFX1 from Ube Industries, Ltd. with 83 parts thereof and 10 parts of an antistat including ethylene oxide Irgastat P18 from Ciba-Geigy. A liquid extracted from the pellet with methanol had a maximum intensity of $5.0\times10^8$ in a total ion chromatogram (TIC).

Example 4

The procedure for preparation of the pellet in Example 1 was repeated except for replacing 93 parts of Nylon 12, UBESTA 3030UFX1 from Ube Industries, Ltd. with 92.7 parts thereof and 0.3 parts of an antistat including ethylene oxide PELECTRON AS from Sanyo Chemical Industries, Ltd. A liquid extracted from the pellet with methanol had a maximum intensity of $4.0\times10^8$ in a total ion chromatogram (TIC).

Example 5

The procedure for preparation of the pellet in Example 1 was repeated except for replacing Nylon 12, UBESTA 3030UFX1 from Ube Industries, Ltd. with PVDF, Kynar 720 from Arkema. A liquid extracted from the pellet with methanol had a maximum intensity of $3.0\times10^8$ in a total ion chromatogram (TIC).

Example 6

The following materials were melted and kneaded in a biaxial extruder.

| | |
|---|---|
| PVDF, Kynar 720 from Arkema | 85.5 |
| Antistat including ethylene oxide Irgastat P18 from Ciba-Geigy | 7 |
| Carbon Black, Denka Black from DENKA DENKI KAGAKU KOGYO KABUSHIKI KAISHA | 7.5 |

The kneaded mixture was pelletized with a pelletizer to obtain a pellet.

A liquid extracted from the pellet with methanol had a maximum intensity of $5.6\times10^8$ in a total ion chromatogram (TIC), and included water in an amount of 1,450 ppm.

Example 7

The following materials were melted and kneaded in a biaxial extruder.

| | |
|---|---|
| PVDF, Kynar 720 from Arkema | 87.5 |
| Antistat Pebax MV1074 from Arkema | 5 |
| Carbon Black, Denka Black from DENKA DENKI KAGAKU KOGYO KABUSHIKI KAISHA | 7.5 |

The kneaded mixture was pelletized with a pelletizer to obtain a pellet.

A liquid extracted from the pellet with methanol had a maximum intensity of $5.6\times10^8$ in a total ion chromatogram (TIC), and included water in an amount of 1,450 ppm.

Example 8

The following materials were melted and kneaded in a biaxial extruder.

| | |
|---|---|
| PVDF, Kynar 720 from Arkema | 89.5 |
| Antistat PELESTAT 201 from Sanyo Chemical Industries, Ltd. | 3 |
| Carbon Black, Denka Black from DENKA DENKI KAGAKU KOGYO KABUSHIKI KAISHA | 7.5 |

The kneaded mixture was pelletized with a pelletizer to obtain a pellet.

A liquid extracted from the pellet with methanol had a maximum intensity of $6.9\times10^8$ in a total ion chromatogram (TIC), and a Martens hardness of 120 N/mm$^2$.

Example 9

The following materials were melted and kneaded in a biaxial extruder.

| | |
|---|---|
| PVDF, Kynar 720 from Arkema | 87.5 |
| Antistat PELESTAT 201 from Sanyo Chemical Industries, Ltd. | 5 |
| Carbon Black, Denka Black from DENKA DENKI KAGAKU KOGYO KABUSHIKI KAISHA | 7.5 |

The kneaded mixture was pelletized with a pelletizer to obtain a pellet.

A liquid extracted from the pellet with methanol had a maximum intensity of $6.9\times10^8$ in a total ion chromatogram (TIC), and a Martens hardness of 102 N/mm$^2$.

Example 10

The following materials were melted and kneaded in a biaxial extruder.

| | |
|---|---|
| PVDF, Kynar 720 from Arkema | 79.5 |
| PVDF, Kynar 2750 from Arkema | 10 |
| Antistat including ethylene oxide PELECTRON AS from Sanyo Chemical Industries, Ltd. | 3 |
| Carbon Black, Denka Black from DENKA DENKI KAGAKU KOGYO KABUSHIKI KAISHA | 7.5 |

The kneaded mixture was pelletized with a pelletizer to obtain a pellet.

A liquid extracted from the pellet with methanol had a maximum intensity of $6.9\times10^8$ in a total ion chromatogram (TIC), and a Martens hardness of 75 N/mm$^2$.

Example 11

The following materials were melted and kneaded in a biaxial extruder.

| | |
|---|---|
| PVDF, Kynar 720 from Arkema | 87.5 |
| Antistat including ethylene oxide PELECTRON AS from Sanyo Chemical Industries, Ltd. | 5 |
| Carbon Black, Denka Black from DENKA DENKI KAGAKU KOGYO KABUSHIKI KAISHA | 7.5 |

The kneaded mixture was pelletized with a pelletizer to obtain a pellet.

A liquid extracted from the pellet with methanol had a maximum intensity of $6.9\times10^8$ in a total ion chromatogram (TIC).

Comparative Example 1

The procedure for preparation of the pellet in Example 1 was repeated except for replacing Nylon 12, UBESTA 3030UFX1 from Ube Industries, Ltd. with Nylon 6, UBE Nylon 5033B from Ube Industries, Ltd. A liquid extracted from the pellet with methanol had a maximum intensity of $8.0\times10^8$ in a total ion chromatogram (TIC).

Comparative Example 2

The procedure for preparation of the pellet in Example 1 was repeated except for replacing 93 parts of Nylon 12, UBESTA 3030UFX1 from Ube Industries, Ltd. with 82 parts thereof and 11 parts of an antistat including ethylene oxide PELECTRON PVH from Sanyo Chemical Industries, Ltd. A liquid extracted from the pellet with methanol had a maximum intensity of $8.5\times10^8$ in a total ion chromatogram (TIC).

[TIC of Liquid Extracted from Pellet with Methanol]

After each of the pellets was molded to have a diameter of 310 mm and a thickness of 0.1 mm with a molder, a sheet having a size of 100 mm×100 mm×0.1 mm was cut out therefrom. After the sheet was left under an environment of 45° C. and 95% RH for 10 days, a sample having a size of 10 mm×40 mm×0.1 mm was cut out therefrom. Next, after the sample was dipped in 2 mL of methanol having a purity of 99.8% in a container under an environment of 23° C. and 50% RH, the container was sealed and the samples was stored for one day to obtain a liquid extracted from the sample with methanol.

TIC of the liquid extracted from the sample with methanol was obtained for 16 min using an LC-MS method under the following conditions.

LC

Column: Acquity UPLC BEH C18 1.7 μm, 2.1 mm×100 mm

Column Temperature: 50° C.

Mobile Phase A: 5 mmol/L Aqueous Solution of Ammonium Acetate

Mobile Phase B: Methanol

Flow Speed: 0.35 mL/min

Gradient 0 min: Mobile Phase A/Mobile Phase B=50/50 (Volume Ratio)

10 min: Mobile Phase A/Mobile Phase B=0/100 (Volume Ratio)

15 min: Mobile Phase A/Mobile Phase B=50/50 (Volume Ratio)

MS

Ionization Method: ESI

Ion Mode: Positive Ion Mode

Capillary Voltage: 3.0 kV

Corona Current: 5.0 μA

Ion Source Heater: 120° C.

Cone Voltage: 50 V

[Water Content of Pellet]

Water content of each of the pellets was measured with a Karl Fischer moisture meter according to JIS-K0113.

[Martens Hardness of Pellet]

After each of the pellets was molded to have a diameter of 310 mm and a thickness of 0.1 mm with a molder, a sheet having a size of 100 mm×100 mm×0.1 mm was cut out therefrom. The Martens hardness of the sheet was measured with a micro hardness meter DUH211-S from Shimadzu Corp. An indenter thereof had a pressure of 10 mN.

Properties of each of the pellets are shown in Table 1.

TABLE 1

| | Thermoplastic Resin | | Parts of | Parts of Conductive | Max. Intensity | Water Content | Martens Hardness |
|---|---|---|---|---|---|---|---|
| | Name | Parts | Antistat | Agent | in TIC | [ppm] | [N/mm$^2$] |
| Example 1 | Nylon | 93 | 0 | 7 | $6.0 \times 10^8$ | — | — |
| Example 2 | Nylon | 88 | 5 | 7 | $6.9 \times 10^8$ | — | — |
| Example 3 | Nylon | 83 | 10 | 7 | $5.0 \times 10^8$ | — | — |
| Example 4 | Nylon | 92.7 | 0.3 | 7 | $4.0 \times 10^8$ | — | — |
| Example 5 | PVDF | 93 | 0 | 7 | $3.0 \times 10^8$ | — | — |
| Example 6 | PVDF | 85.5 | 7 | 7.5 | $5.6 \times 10^8$ | 1450 | — |
| Example 7 | PVDF | 87.5 | 5 | 7.5 | $3.6 \times 10^8$ | 800 | — |
| Example 8 | PVDF | 89.5 | 3 | 7.5 | $6.9 \times 10^8$ | — | 120 |
| Example 9 | PVDF | 87.5 | 5 | 7.5 | $6.9 \times 10^8$ | — | 102 |
| Example 10 | PVDF | 89.5 | 3 | 7.5 | $6.9 \times 10^8$ | — | 75 |
| Example 11 | PVDF | 87.5 | 5 | 7.5 | $6.9 \times 10^8$ | — | — |
| Comparative Example 1 | Nylon | 93 | 0 | 7 | $8.0 \times 10^8$ | — | — |
| Comparative Example 2 | Nylon | 82 | 11 | 7 | $8.5 \times 10^8$ | — | — |

[Preparation of Seamless Belt]

Each of the pellets was extruded from an eighth-power spiral die with a monoaxial melt-kneader to form a seamless belt having a width of 310 mm and a circumferential length of 960 mm. In addition, a sizing die was set inside the pellet extruded from the die.

Next, image void in an environment of high-temperature and high-humidity, defective cleaning and variation of the surface resistivity of the seamless belt were evaluated.

[Image Void in Environment of High-Temperature and High-Humidity]

After the seamless belt was installed in an image forming apparatus MPC3003 from Ricoh Company, Ltd., the seamless belt was left under an environment of 45° C. and 95% RH while contacted to the photoconductor for 10 days. Next, images were produced to evaluate image void.

Good: No image void or no image void after 10 images were produced

Poor: There was image void even after 10 images were produced

[Defective Cleaning]

After the seamless belt was installed in an image forming apparatus MPC3003 from Ricoh Company, Ltd., 10,000 images having a printing rate of 0.5% were produced to evaluate defective cleaning.

Good: No stripe image

Poor: Stripe image

[Variation of Surface Resistivity]

The seamless belt was applied with a voltage of 500 V and the surface resistivities [Log (Ω/□)] of 38 points at an interval of 25 mm on the seamless belt were measured using Hiresta URS probe from Mitsubishi Chemical Analytech Co., Ltd. to evaluate variation of the surface resistivity.

Good: A difference between a maximum value and a minimum value of the surface resistivity is not greater than 1

Poor: A difference between a maximum value and a minimum value of the surface resistivity is greater than 1

The evaluation results of the image void in an environment of high-temperature and high-humidity, the defective cleaning and the variation of the surface resistivity of the seamless belt are shown in Table 2.

TABLE 2

| | Image Void | Defective Cleaning | Variation of Surface Resistivity |
|---|---|---|---|
| Example 1 | Good | Good | Good |
| Example 2 | Good | Good | Good |
| Example 3 | Good | Good | Good |
| Example 4 | Good | Good | Poor |
| Example 5 | Good | Good | Good |
| Example 6 | Good | Good | Good |
| Example 7 | Good | Good | Good |
| Example 8 | Good | Good | Good |
| Example 9 | Good | Good | Good |
| Example 10 | Good | Good | Good |
| Example 11 | Good | Good | Good |
| Comparative Example 1 | Poor | Poor | Good |
| Comparative Example 2 | Poor | Poor | Good |

Table 2 proves the seamless belts of Examples 1 to 11 prevent the image void in an environment of high-temperature and high-humidity and the defective cleaning.

In contrast, the seamless belts of Comparative Examples 1 and 2 have image void in an environment of high-temperature and high-humidity and the defective cleaning because a liquid extracted from each of the pellets with methanol has an intensity greater than $7\times10^8$ in a TIC.

Having now fully described the invention, it will be apparent to one of ordinary skill in the art that many changes and modifications can be made thereto without departing from the spirit and scope of the invention as set forth therein.

What is claimed is:

1. A composition for seamless belt, comprising:

a thermoplastic resin; and a conductive agent, wherein the composition has an ion conductive property characterized by performing a method comprising:

(a) treating the composition that comprises the thermoplastic resin and the conductive agent with methanol to extract a liquid; and (b) performing a total ion chromatogram on the liquid extracted in (a) and determining that said liquid has a total ion chromatogram intensity not greater than $7\times10^8$.

2. The composition of claim 1, further comprising:

an antistat comprising alkylene oxide in an amount of from 0.5% to 10% by weight based on a total weight of the composition, wherein a liquid extracted with methanol from the composition including the antistat has a total ion chromatogram intensity not greater than $7\times10^8$.

3. The composition of claim 1, wherein the thermoplastic resin is at least one of a polyvinylidene fluoride-hexafluoropropylene copolymer and a vinylidene fluoride-hexafluoropropylene copolymer.

4. A seamless belt produced by a process comprising:

(i) melting and kneading a thermoplastic resin and a conductive agent to obtain a composition in which the conductive agent is dispersed in the thermoplastic resin, wherein the composition has an ion conductive property characterized by performing a method comprising:

(a) treating the composition that comprises the thermoplastic resin and the conductive agent with methanol to extract a liquid; and (b) performing a total ion chromatogram on the liquid extracted in (a) and determining that said liquid has a total ion chromatogram intensity not greater than $7\times10^8$; and (ii) extrusion molding the composition into a mold for the seamless belt.

5. An image forming apparatus, comprising:

a seamless belt according to claim 4;

a photoconductor;

a charger to charge the photoconductor;

an irradiator to irradiate the charged photoconductor to form an electrostatic latent image thereon;

an image developer to develop the electrostatic latent image with a toner to form a toner image on the photoconductor;

a first transferer to transfer the toner image onto the seamless belt;

a second transferer to transfer the toner image onto a recording medium; and a cleaning blade to clean the seamless belt the toner image transferred from.

6. A composition for seamless belt, comprising:

a thermoplastic resin;

a conductive agent; and water in an amount of from 500 to 1,500 ppm, wherein the composition has an ion conductive property characterized by performing a method comprising;

(a) treating the composition that comprises the thermoplastic resin and the conductive agent with methanol to extract a liquid; and (b) performing a total ion chromatogram on the liquid extracted in (a) and determining that said liquid has a total ion chromatogram intensity not greater than $7\times10^8$.

* * * * *